US005868346A

United States Patent [19]

Cobos

[11] Patent Number: 5,868,346

[45] Date of Patent: Feb. 9, 1999

[54] TOWEL ROLL HOLDER AND TOWEL DISPENSER

[76] Inventor: Charles R. Cobos, P.O. Box 32, Bryan, Tex. 77806

[21] Appl. No.: 900,542

[22] Filed: Jul. 25, 1997

Related U.S. Application Data

[60] Provisional application No. 60/022,715, Jul. 26, 1996.

[51] Int. Cl.[6] ..... B65H 19/00

[52] U.S. Cl. ..... 242/593; 312/34.8

[58] Field of Search ..... 242/593, 595, 242/596.8, 597.8, 598.5, 598.6; 312/34.2, 34.8

[56] References Cited

U.S. PATENT DOCUMENTS

| | | | |
|---|---|---|---|
| 764,806 | 7/1904 | Ham | 312/34.8 |
| 883,538 | 3/1908 | Graser | 312/34.8 |
| 1,423,336 | 7/1922 | Korittke | 312/34.8 |
| 2,182,831 | 12/1939 | Wagner | 312/34.8 |
| 2,991,951 | 7/1961 | Carroll | 242/597.8 |
| 3,523,653 | 8/1970 | Hansen | 242/593 |
| 5,141,171 | 8/1992 | Yang | 242/593 |
| 5,170,958 | 12/1992 | Brown | 312/34.8 |
| 5,255,800 | 10/1993 | Kelly | 242/595 |
| 5,346,064 | 9/1994 | Rizzuto | 312/34.8 |

FOREIGN PATENT DOCUMENTS

| | | | |
|---|---|---|---|
| 0 107 487 A1 | 5/1984 | European Pat. Off. | 242/593 |
| 0 300 357 A1 | 1/1989 | European Pat. Off. | 242/595 |
| WO 81/02880 | 10/1981 | WIPO | 242/593 |

*Primary Examiner*—John P. Darling
*Attorney, Agent, or Firm*—William E. Shull

[57] ABSTRACT

A towel roll holder and towel dispenser includes a housing for retaining a roll of toweling. The housing is affixed to a support surface, and easily opened or removed for replacement of the roll. In one embodiment, Velcro strips mounted on the support surface releasably engage oppositely configured Velcro strips mounted on an outwardly extending flange on the base of the housing. In another embodiment, magnetic strips or ferromagnetic material mounted on the support surface releasably attach to complementary strips on the housing flanges. In another embodiment, one side or end of the housing base flange is hinged to the support surface, and the opposite side or end of the housing base flange is releasably attached to the support surface with Velcro or magnetic (or ferromagnetic) strips as referred to above, or a rotatable latch. Towels may be dispensed from a narrow end of a cone-shaped nozzle on the end of the housing, or through a slot in a housing wall.

8 Claims, 4 Drawing Sheets

TOWEL ROLL HOLDER AND TOWEL DISPENSER

CROSS REFERENCES TO RELATED APPLICATIONS

This application is related to U.S. Provisional Application No. 60/022,715, filed Jul. 26, 1996, the disclosure of which is incorporated herein by reference and the benefit of the filing date of which is claimed under 35 U.S.C. § 119(e).

BACKGROUND OF THE INVENTION

The present invention relates generally to towel roll holders and towel dispensers, and more particularly to a plastic housing for retaining a roll of toweling made, for example, of paper, cloth, fabric, or the like, so that the individual towels of the roll can be easily dispensed therefrom, and so that a new roll can be quickly and easily inserted into the housing when the old roll is exhausted. Still more particularly, the present invention relates to such a housing that is easily affixed to a wall, cabinet, appliance, or other surface, and easily opened or removed for replacement of the roll.

Plastic towel roll holders with cone-shaped dispenser nozzles are known in the art. Such holders have typically been affixed to a wall or other surface in grocery stores, restaurants, or other commercial establishments so that a towel or towels can be dispensed from the roll as needed for wiping up spills, cleaning, and the like. A drawback with the prior art towel roll holders is that they have been affixed to their support surfaces by screws, thus requiring the screws to be removed and reinserted each time a new roll is placed within the housing. This is not only time consuming, but also annoying in that sometimes the screws are fumbled with, dropped or lost, or there is no screwdriver handy of the correct size or profile.

The present invention overcomes these drawbacks by providing a screwless, easily opened or removed, easily closed or replaced mounting for the housing that enables the operator to quickly and easily replace the exhausted roll of toweling with a new roll. With the present invention, there are no lost or dropped screws, no screwdriver to hunt down, no fumbling, and no wasted time laboriously removing and reinserting the screws.

SUMMARY OF THE INVENTION

In one embodiment, the present invention includes a pair of Velcro strips (either one of which can be a "hook" or a "loop") mounted on the wall or other support surface, and a pair of oppositely configured Velcro strips (i.e., loop or hook) mounted on flanges on the towel roll retainer housing, spaced and disposed so as to mate with the Velcro strips on the support surface.

In another embodiment, the present invention includes a pair of magnetic strips or ferromagnetic material (or one strip of each) mounted on the wall or other support surface, and a pair of complementary strips (i.e., ferromagnetic material or magnet) mounted on flanges on the towel roll retainer housing, spaced and disposed so as to magnetically attach to the strips mounted on the support surface.

In another embodiment, the present invention includes a hinge along one side or end of the towel roll retainer housing, with one flange of the hinge attached to the wall or other support surface, and the other flange of the hinge attached to a side or end flange or edge of the towel roll retainer housing. Along the other side or end flange or edge of the towel roll retainer housing, according to one version of this embodiment of the invention there is disposed a Velcro strip, which mates with a Velcro strip of the opposite configuration which is mounted on the wall or other support surface. According to another version of this embodiment of the invention, there is a magnetic strip or a strip of ferromagnetic material disposed along said other side or end flange or edge opposite the hinge, which magnetically attaches to a strip of magnetically complementary material (i.e., ferromagnetic material or magnet) which is mounted on the wall or other support surface. According to still another version of this embodiment of the invention, a rotatable latch is mounted on the wall or other support surface, and may be rotated into and out of latching engagement with said other side or end flange or edge of the towel roll retainer housing.

In one embodiment of the present invention, a substantially cone-shaped, hollow nozzle having open larger and smaller ends is mounted with the larger end around an opening in one end of the towel roll retainer housing. Towels may be pulled, i.e. dispensed, from the roll through the opening in the small end of the nozzle.

In another embodiment of the present invention, a preferably longitudinally axially extending slot is disposed in the wall of the towel roll retainer housing, and the towels are dispensed from the roll directly through the slot, instead of through a nozzle.

These and other objects and advantages of the present invention will become apparent from the following description of the preferred embodiments when read in conjunction with reference to the following drawings, wherein:

DETAILED DESCRIPTION OF THE PREFERRED EMBODIMENTS OF THE INVENTION

Figure 1:
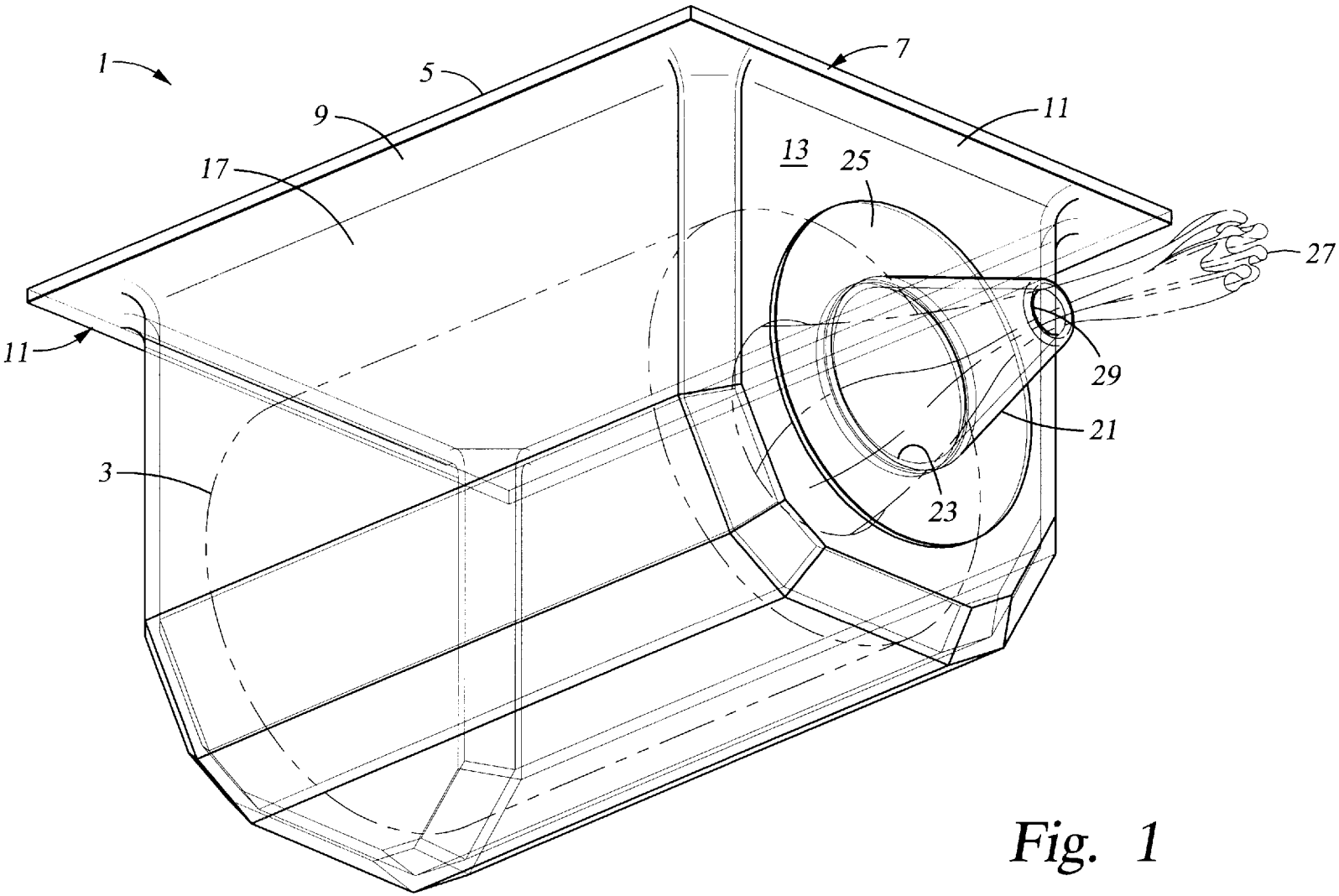
FIG. 1 is an isometric, pictorial view of a towel roll retainer housing of the present invention, including an end nozzle through which towels may be dispensed.

Turning to FIG. 1, a towel roll retainer housing of the present invention is shown generally at 1. Housing 1 may be made of plastic or other suitable material, and preferably is made of clear plastic so that the roll 3 of toweling may be seen through the housing. An outwardly extending flange 5 extends around the base 7 of the housing, and includes a pair of oppositely disposed side flange portions 9 and a pair of oppositely disposed end flange portions 11. Housing 1 has end walls 13, 15 and main body wall 17 extending therebetween, creating a hollow enclosure for the roll 3. Housing 1 has an open end at base 7 through which roll 3 may be inserted into or removed from the housing.

A substantially cone-shaped, hollow nozzle 21 having open larger and smaller ends is mounted with the larger end around an opening 23 in one end of the towel roll retainer housing 1. The base of nozzle 21 includes an outwardly extending flange 25 which is secured, as by bonding, to the end wall of the housing. Towels 27 may be pulled, i.e. dispensed, from the roll 3 through the opening 29 in the small end of the nozzle.

Figure 2:
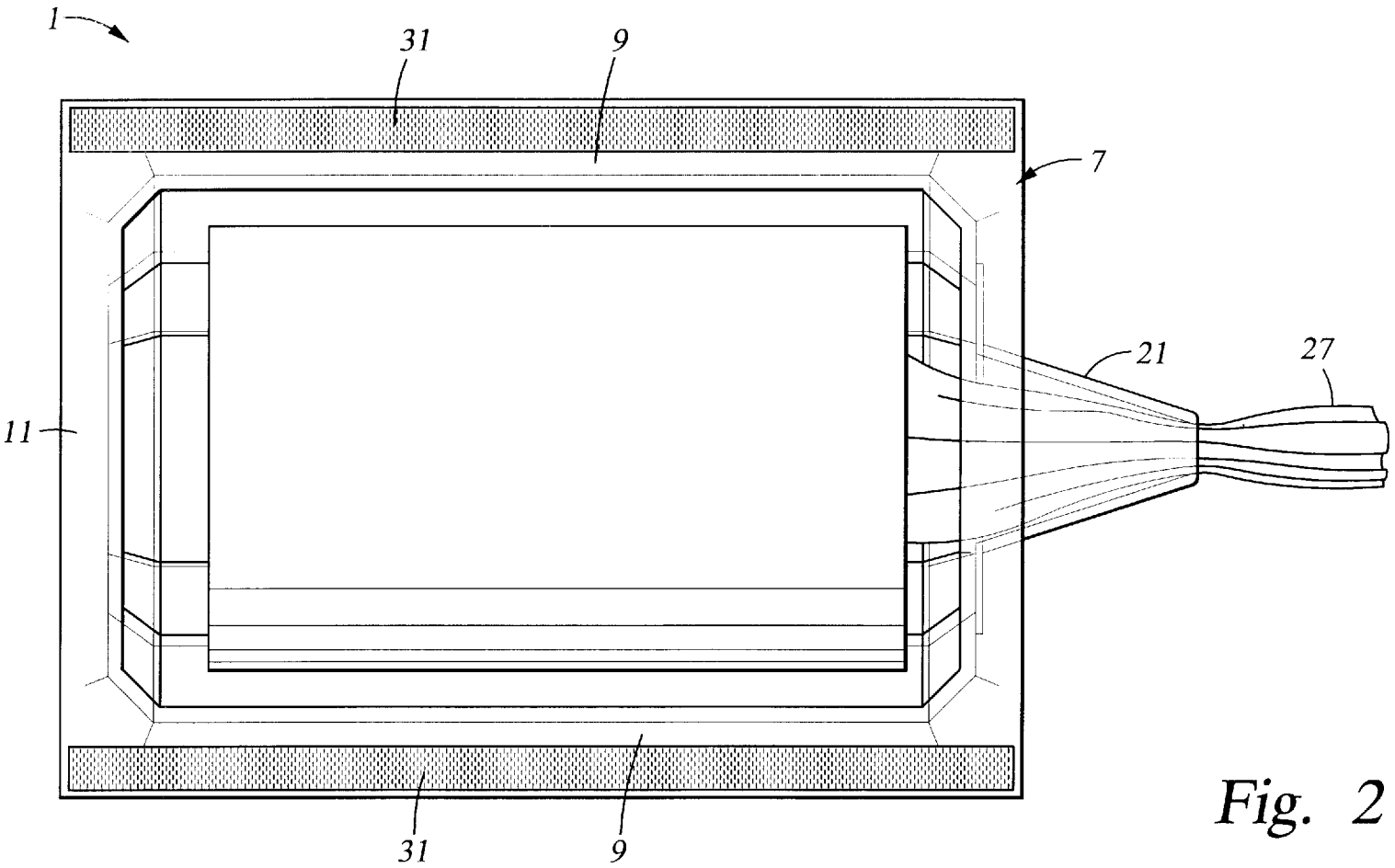
FIG. 2 is a top plan view of the towel roll retainer housing of FIG. 1.
Figure 3:
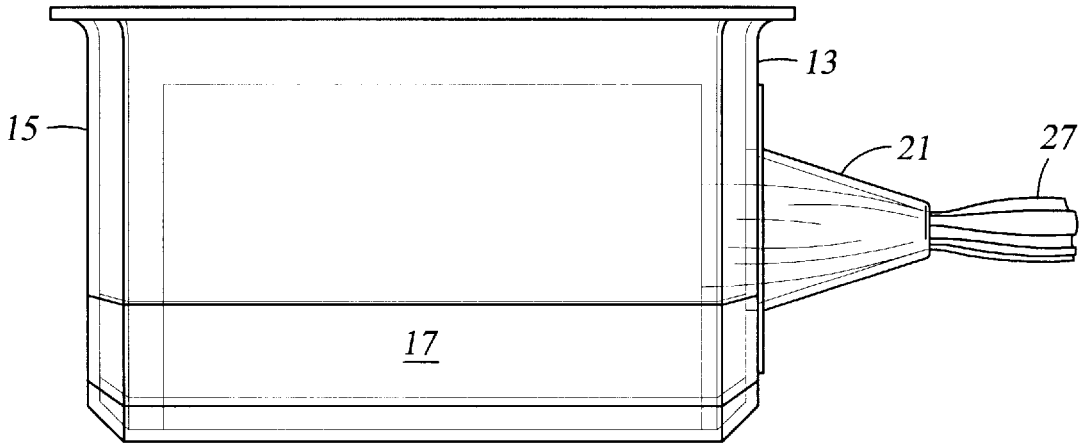
FIG. 3 is a side elevation of the towel roll retainer housing of FIG. 1.
Figure 4:
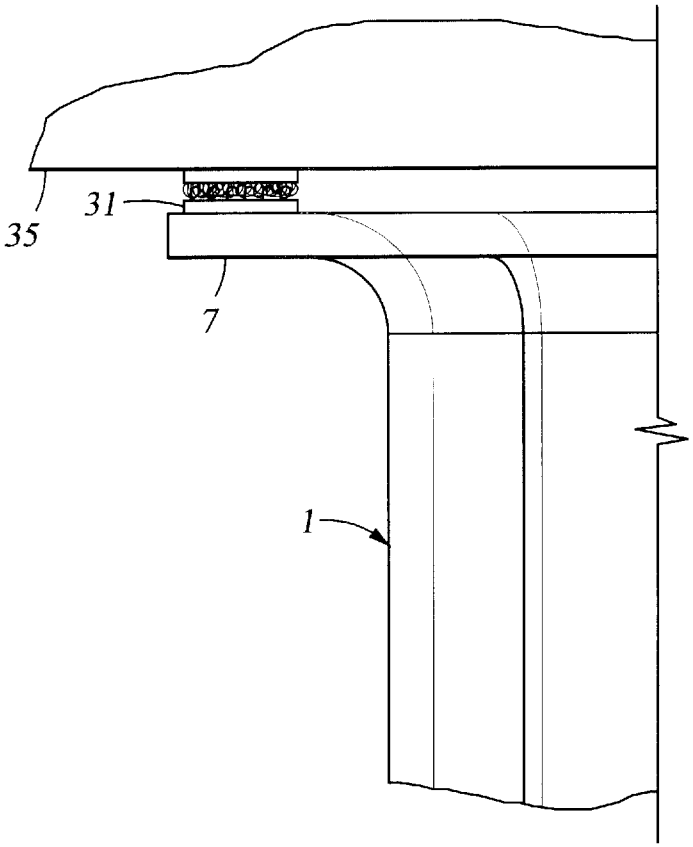
FIG. 4 is a fragmentary, enlarged view of a portion of a side or end flange of one form of mounting of the towel roll retainer housing of FIG. 1, showing a Velcro strip attached to the upper surface of the side or end flange, and a complementary Velcro strip mounted on a wall or other support surface.

As shown in FIG. 2, a pair of Velcro strips 31 are attached to the side flanges 9 of base 7 of housing 1. Alternatively, strips 31 could be mounted on end flanges 11. As shown in FIG. 4, Velcro strips 31 affix to complementary Velcro strips 33 mounted on a wall or other support surface 35. Thus, detachable Velcro strips 31, 33 enable housing 1 to be easily attached to and removed from the wall 35.

Alternatively, strips 31 shown in FIG. 2 could be magnets, or they could be made of a ferromagnetic material, and strips 33 shown in FIG. 4 could be magnetically complementary, i.e., ferromagnetic material or magnets. Thus, housing 1 could be magnetically attached to wall 35, thereby being easily attached to and removed from the wall for inserting or removing a roll 3 into or from the housing.

Figure 5:
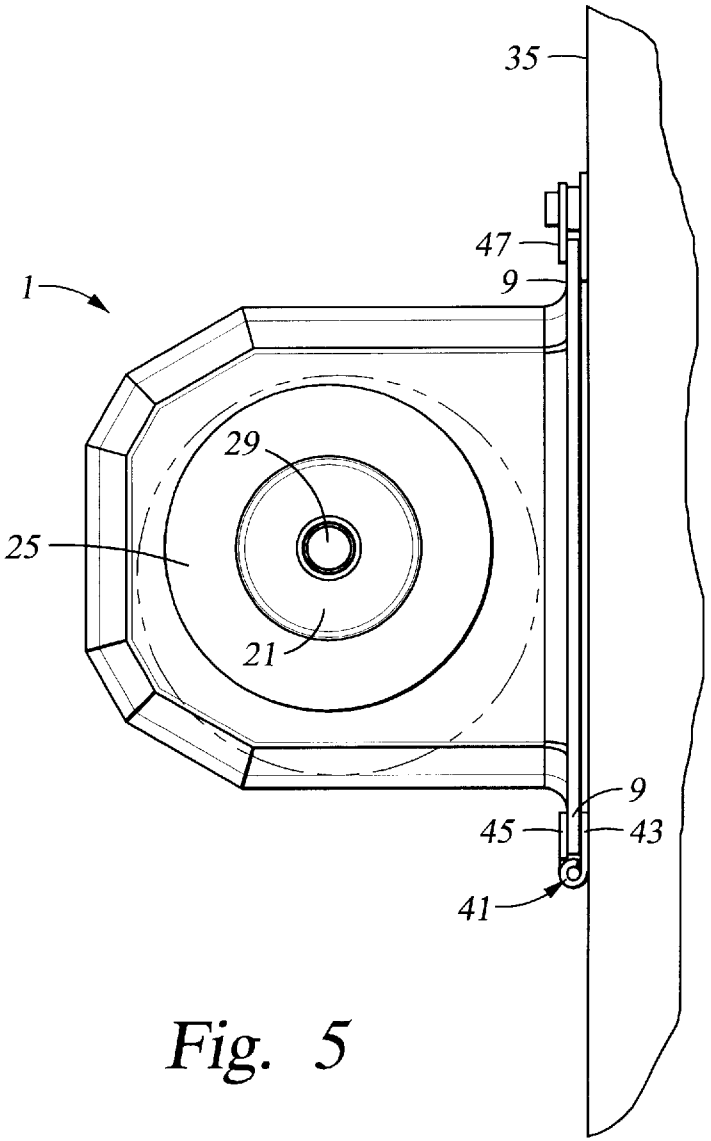
FIG. 5 is an end view of an alternative form of mounting the towel roll retainer housing of FIG. 1, showing a hinge along one side flange or edge and a rotatable latch in engagement with the other, opposite side flange or edge of the housing.

Another alternative form of mounting housing 1 to wall 35 is shown in FIG. 5. A hinge 41 is disposed along one side of housing 1, with one flange 43 of the hinge attached to the wall, and the other flange 45 of the hinge attached to a side flange 9 of the housing. Along the other side flange of the housing, according to one version of this embodiment of the invention there is disposed a Velcro strip 31, which mates with a Velcro strip 33 of the opposite configuration which is mounted on the wall or other support surface. According to another version of this embodiment of the invention, there is a magnetic strip or a strip of ferromagnetic material disposed along this other side flange, which magnetically attaches to a strip of magnetically complementary material (i.e., ferromagnetic material or magnet) which is mounted on the wall. According to still another version of this embodiment of the invention, a rotatable latch 47 is mounted on the wall, and may be rotated into and out of latching engagement with the flange 9.

Instead of Velcro or magnets, other suitable removable attachment means may be used to removably mount the housing 1 to the wall 35, such as tacky adhesives, snaps, double-sided tape, or the like.

If Velcro is used, then it is preferred that the housing 1 be configured so that when the housing is pressed against the wall, there is slightly more space between the flange surface and the wall at the ends of strips than there is at the middle, in order that the Velcro connection not be as tight at the ends of the strips. In this way, the Velcro attachment will not be as great or as tight at the ends of the strips, and this will help keep the strips from pulling away from the wall when the housing is removed for replacement of the roll 3.

Figure 6:
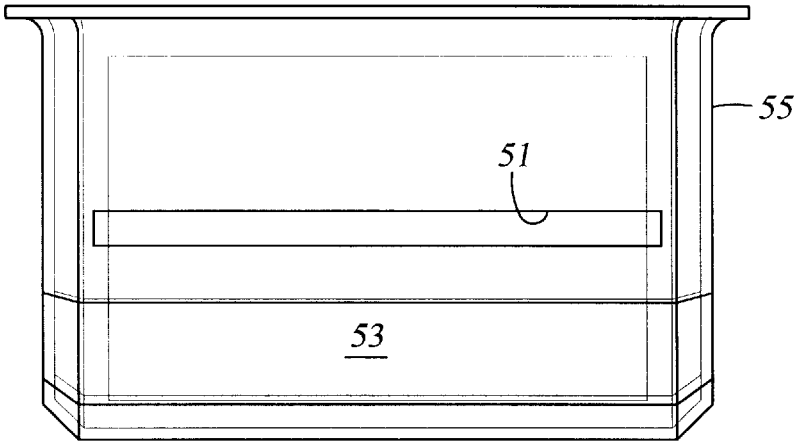
FIG. 6 is a side elevation of an alternative embodiment of a towel roll retainer housing of the present invention, showing a longitudinally axially extending slot in the housing through which towels may be dispensed.

Another alternative embodiment of the invention is shown in FIG. 6. A preferably longitudinally axially extending slot 51 is disposed in the main body wall 53 of the towel roll retainer housing 55, and the towels are dispensed from a roll directly through the slot, instead of through a nozzle. Housing 55 may be attached to the wall or other support surface by any means described above. It should be understood that a slot 51 could also be disposed in the end wall of the housing. Also, a nozzle such as nozzle 21 may be mounted on an end wall of the housing 55, if desired.

While preferred embodiments of the invention have been shown and described, many modifications thereof may be made by those skilled in the art without departing from the spirit of the invention. Accordingly, the scope of the invention should be determined in accordance with the following claims.

I claim:

1. A towel roll holder and towel dispenser adapted for mounting on a support surface, comprising:

a housing for receiving a towel roll therewithin, said housing having a base, and also having an opening therein through which towels may be dispensed from the roll;

a flange disposed on said base of said housing, said flange having an upper surface and an underside surface;

first releasable screwless fastening means adapted for mounting on the support surface for engagement with said housing, comprising a first pair of hook and loop strips adapted to be mounted in spaced apart relationship on the support surface; and second releasable screwless fastening means disposed on said flange of said housing for releasably engaging said first fastening means when said first fastening means is mounted on the support surface for releasably affixing said housing to the support surface, said second releasable screwless fastening means comprising a second pair of complementary loop and hook strips mounted on opposite sides of said housing on said underside surface of said flange for releasably engaging said first pair of hook and loop strips when mounted on the support surface;

said housing being configured so that the connection between said first pair of hook and loop strips and said second pair of loop and hook strips will not be as tight at the ends of said strips as in the middle of said strips for helping to keep said strips from pulling away from said flange and said support surface when said housing is removed, there being slightly more space between said underside surface of said flange and said support surface at the ends of said strips than in the middle of said strips when said housing is mounted on said support surface.

2. A towel roll holder and towel dispenser according to claim 1, wherein said housing includes a cone-shaped nozzle on one end, the smaller end of said nozzle being a free end and comprising said opening through which towels may be dispensed.

3. A towel roll holder and towel dispenser according to claim 1, wherein said housing includes a longitudinally axially extending slot in a side wall thereof, said slot comprising said opening through which towels may be dispensed.

4. A towel roll holder and towel dispenser according to claim 1, wherein said housing is made of clear plastic.

5. A towel roll holder and towel dispenser adapted for mounting on a support surface, comprising:

a housing for receiving a towel roll therewithin, said housing having a base, and also having an opening therein through which towels may be dispensed from the roll;

a flange disposed on said base of said housing, said flange having an upper surface and an underside surface;

a hinge having one flanged portion mounted on said upper surface of said flange of said housing and another flanged portion adapted to be mounted on the support surface for hingedly attaching one side of said housing to the support surface;

first releasable screwless fastening means adapted for mounting on the support surface for engagement with an opposite side of said housing from said hinge, comprising a first hook and loop strip; and second releasable screwless fastening means disposed on said flange of said housing on said opposite side thereof, for releasably engaging said first fastening means when said first fastening means is mounted on the support surface for releasably affixing said opposite side of said housing to the support surface, said second releasable screwless fastening means comprising a second complementary loop and hook strip mounted on said opposite side of said housing on said underside surface of said flange for releasably engaging said first hook and loop strip when mounted on the support surface;

said housing being configured so that the connection between said first hook and loop strip and said second loop and hook strip will not be as tight at the ends of said strips as in the middle of said strips for helping to keep said strips from pulling away from said flange and said support surface when said housing is removed, there being slightly more space between said underside surface of said flange and said support surface at the ends of said strips than in the middle of said strips when said housing is mounted on said support surface.

6. A towel roll holder and towel dispenser according to claim 5, wherein said housing includes a cone-shaped nozzle on one end, the smaller end of said nozzle being a free end and comprising said opening through which towels may be dispensed.

7. A towel roll holder and towel dispenser according to claim 5, wherein said housing includes a longitudinally axially extending slot in a side wall thereof, said slot comprising said opening through which towels may be dispensed.

8. A towel roll holder and towel dispenser according to claim 5, wherein said housing is made of clear plastic.

* * * * *